US007222807B2

(12) United States Patent
Azzolin

(10) Patent No.: US 7,222,807 B2
(45) Date of Patent: May 29, 2007

(54) BUCKET FOR CRUSHING AND SCREENING STONE

(75) Inventor: Guido Azzolin, Breganze (IT)

(73) Assignee: Meccanica Breganzese S.r.l., Fara Vicentino (IT)

( * ) Notice: Subject to any disclaimer, the term of this patent is extended or adjusted under 35 U.S.C. 154(b) by 140 days.

(21) Appl. No.: 10/525,890

(22) PCT Filed: Aug. 29, 2002

(86) PCT No.: PCT/IT02/00555

§ 371 (c)(1),
(2), (4) Date: Feb. 25, 2005

(87) PCT Pub. No.: WO2004/020747

PCT Pub. Date: Mar. 11, 2004

(65) Prior Publication Data

US 2005/0242220 A1 Nov. 3, 2005

(51) Int. Cl.
*B02C 1/06* (2006.01)

(52) U.S. Cl. ..... 241/201; 241/101.73; 241/266

(58) Field of Classification Search ..... 241/201, 241/205, 219, 101.73, 264–269
See application file for complete search history.

(56) References Cited

U.S. PATENT DOCUMENTS 1,954,288 A 4/1934 Francis
2,500,109 A 3/1950 Hibbard
2,605,051 A 7/1952 Bogle
3,959,897 A 6/1976 May

FOREIGN PATENT DOCUMENTS

DE 580 475 7/1933
EP 0 773 065 5/1997
EP 1 138 834 10/2001

*Primary Examiner*—Mark Rosenbaum
(74) *Attorney, Agent, or Firm*—Stradley Ronon Stevens & Young, LLP

(57) ABSTRACT

A bucket for crushing and screening stone and similar materials. The bucket has a scoop-shaped body defining an inlet opening for the stone to be crushed and an outlet opening for the crushed stone, between which a direction of flow of the stone is defined. The bucket further has a stone-crushing mechanism including a first jaw and a second jaw housed in the scoop-shaped body and movable relative to one another. The bucket still further has an element for moving the first jaw relative to the second jaw. The element imparts to the first jaw a combined rotational and translational movement relative to the second jaw in which a first component of the movement is away from and towards the second jaw and a second component of the movement is substantially parallel to the direction of flow.

20 Claims, 4 Drawing Sheets

1

2
5
20a
20b
6
20

BUCKET FOR CRUSHING AND SCREENING STONE

TECHNICAL FIELD

The present invention relates to a bucket for crushing and screening stone and similar materials.

TECHNOLOGICAL BACKGROUND

In the technical field in question, self-propelled vehicles equipped with buckets for collecting material such as stone or the like, inside which a crushing mechanism is provided for crushing the material collected to the desired size, are known.

Amongst others, an example of a known crushing mechanism comprises two jaws, of which one moves pivotably relative to the other. The jaws are moved in a manner such as to compress between them, and hence to crush, the material which is introduced into the bucket. However, this crushing mechanism leads to some disadvantages which result in poor performance and non-homogeneity in the processing of the material treated. Known buckets therefore have high power consumption and are subject to blockage due to choking with the material introduced.

Stone crushing devices are known from U.S. Pat. No. 3,959,897, U.S. Pat. No. 1,954,288 and DE 580475. The first document discloses an excavating bucket having a vibrating cutter head and a crusher including a pair of jaws that are moved toward one another by an eccentric oscillating shaft. The shaft oscillation is so limited as to produce just an up-and-down movement of the jaws.

SUMMARY OF THE INVENTION

The main object of the present invention is to provide a bucket for crushing and screening stone and similar materials in which the crushing operation is particularly effective and efficient.

A further object is to provide a bucket in which the size of the crushed material is easily adjustable.

Another object is to produce a bucket which is subject to little or no obstruction due to blockage with the material treated.

Yet another object is to produce a bucket which can be adapted to a plurality of self-propelled vehicles and which can easily be produced in many different sizes.

A further object is to provide a bucket which permits optimal, in particular homogeneous, crushing of a plurality of different materials.

The objects proposed are achieved by the present invention by providing a bucket including a scoop-shaped body. The body defines an inlet opening for the stone to be crushed and an outlet for the crushed stone, between which a direction of flow of the stone is defined. The mechanism for crushing the stone has a first jaw and a second jaw housed in the scoop-shaped body and movable relative to one another, and an element for moving the first jaw relative to the second jaw. The element can impart to the first jaw a combined rotational and translational movement relative to the second jaw, in which a first component of the movement is away from and towards the second jaw and a second component of the movement is substantially parallel to the direction of flow.

It is to be understood that both the foregoing general description and the following detailed description are exemplary, but are not restrictive, of the invention.

BRIEF DESCRIPTION OF THE DRAWINGS

The characteristics and the advantages of the invention will become clearer from the detailed description of two embodiments thereof, described by way of non-limiting example with reference to the appended drawings. It is emphasized that, according to common practice, the various features of the drawings are not to scale. On the contrary, the dimensions of the various features are arbitrarily expanded or reduced for clarity. Included in the drawings are the following figures.

PREFERRED EMBODIMENTS OF THE INVENTION

Figure 1:
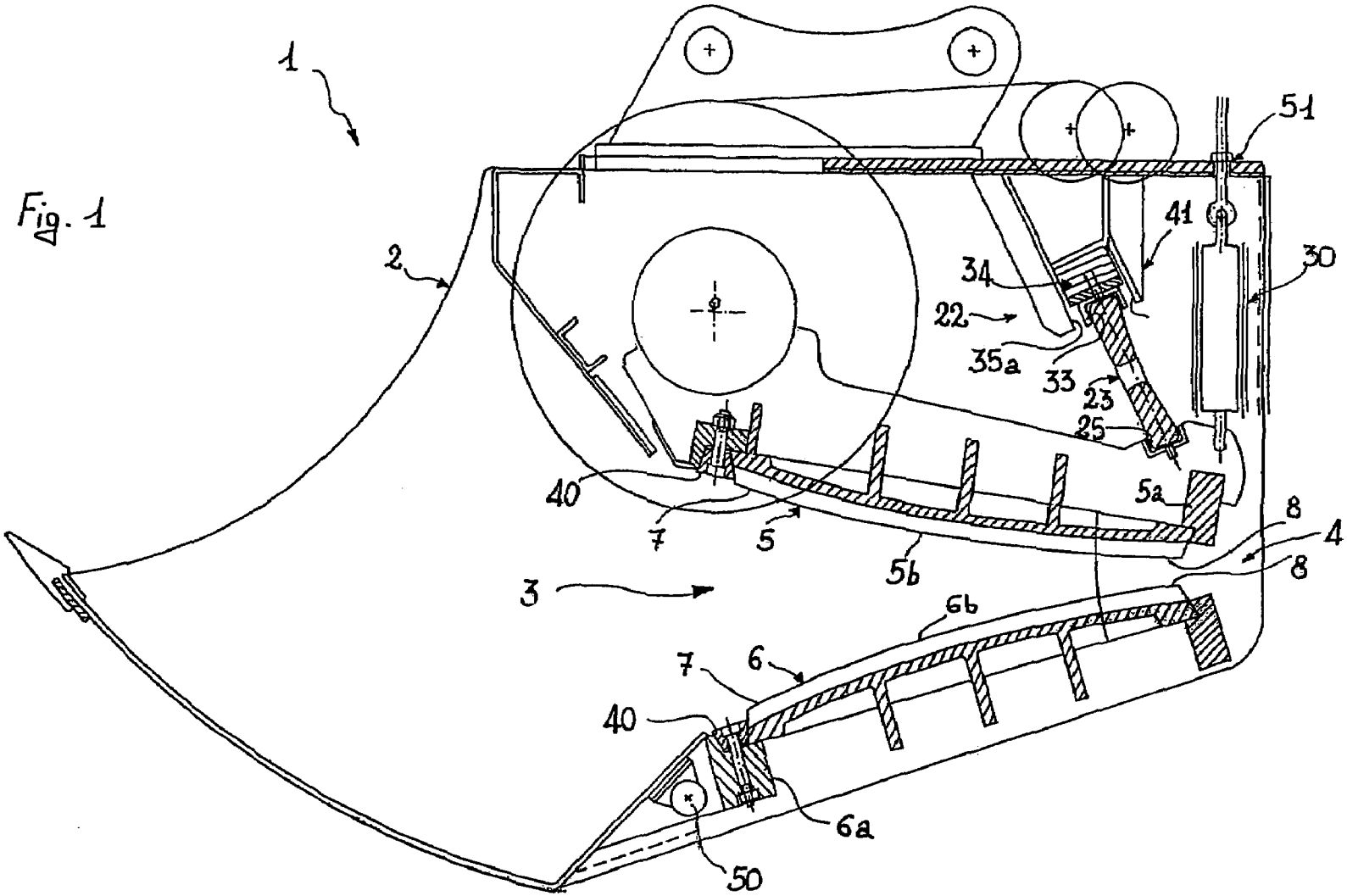
FIG. 1 is a partially sectioned side view of a bucket according to the invention.
Figure 2:
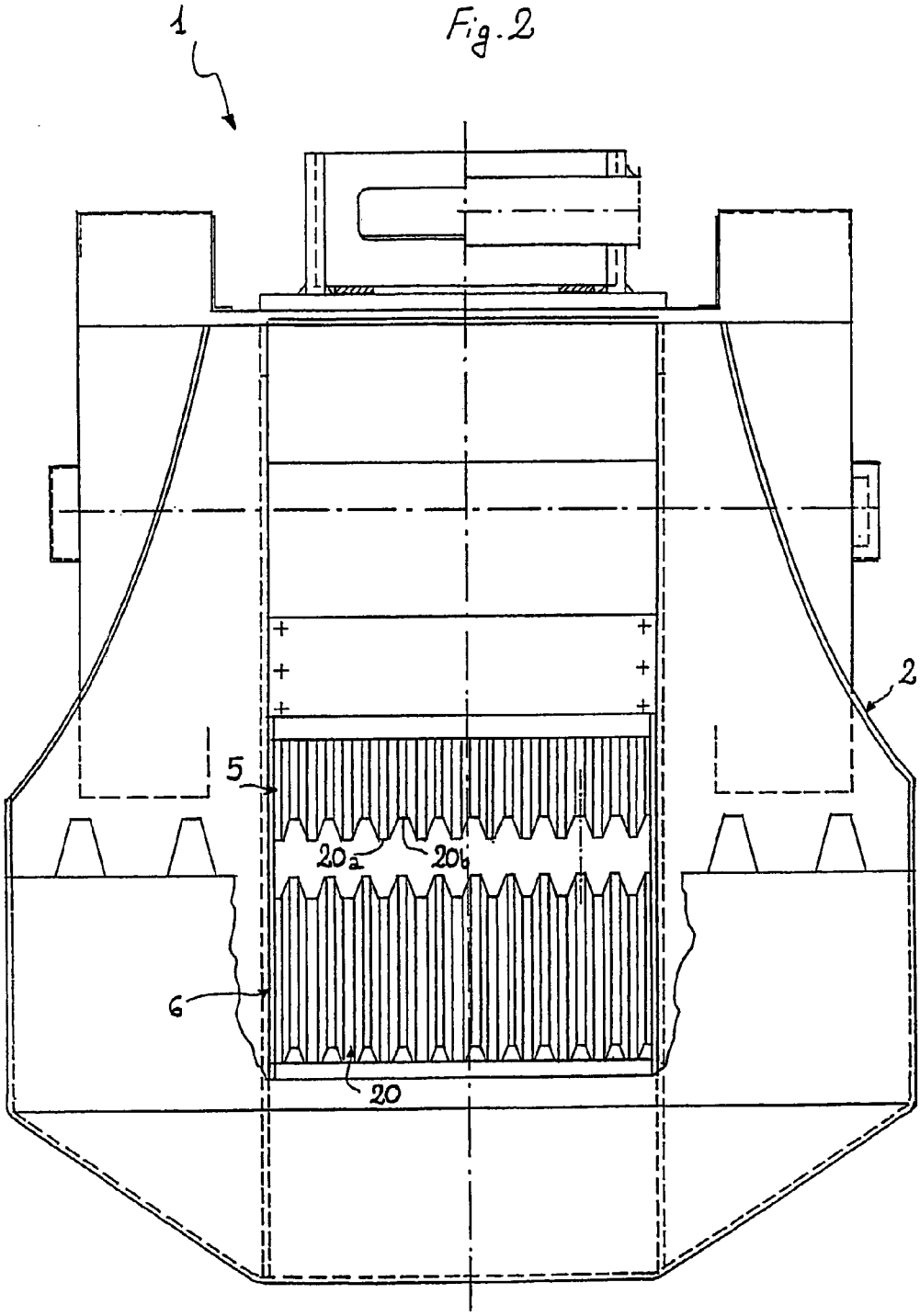
FIG. 2 is a partially sectioned plan view of the bucket of FIG. 1.
Figure 3:
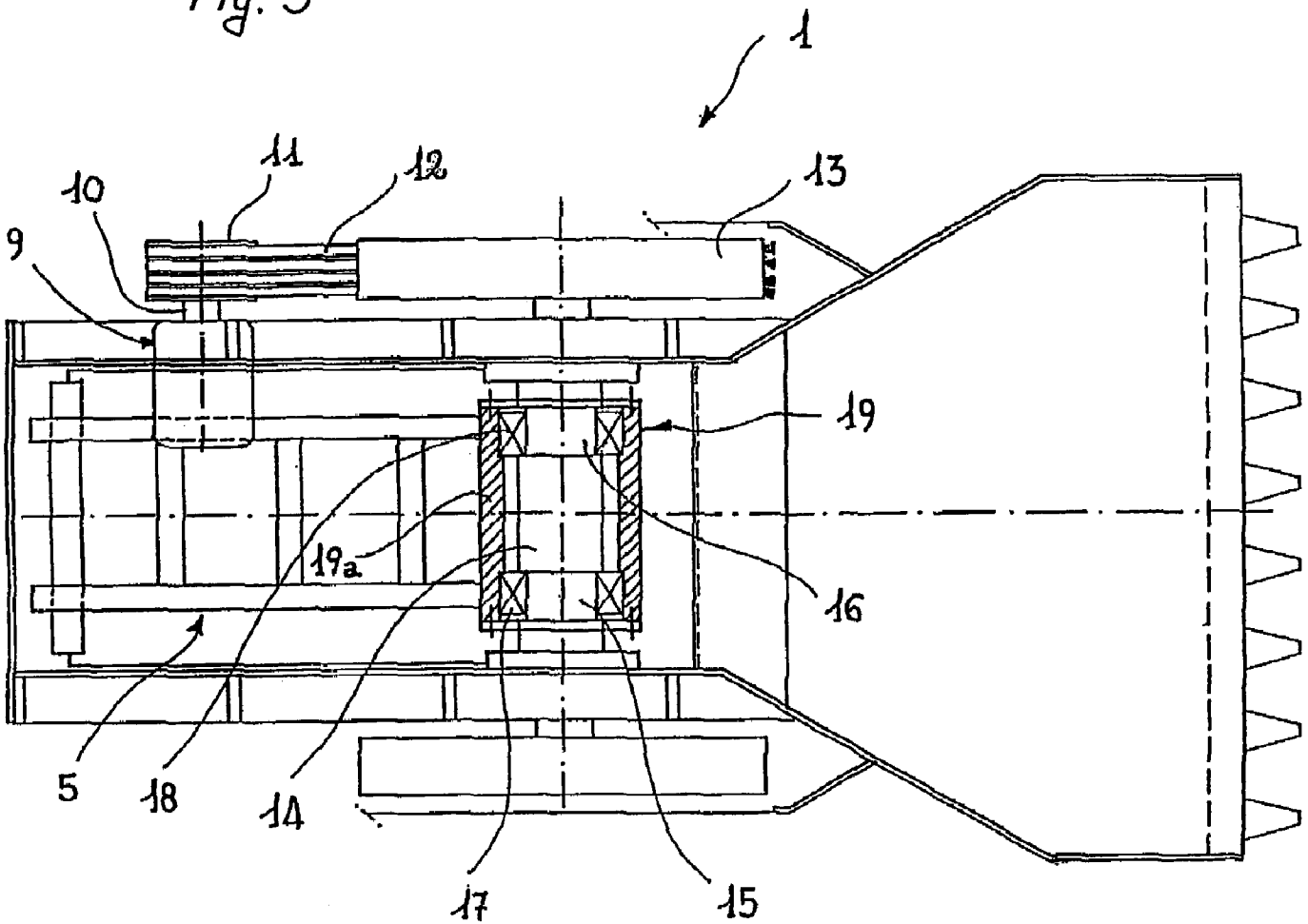
FIG. 3 is a partially sectioned front view of the bucket of FIG. 1.

In the drawings, in which like reference numbers refer to like elements throughout the various figures that comprise the drawings, a bucket formed in accordance with the present invention is generally indicated by reference number 1.

The bucket 1 is arranged for connection, in a known manner, to one or more arms of a self-propelled vehicle (not shown).

The bucket 1 comprises a scoop-shaped body 2 having an inlet opening 3 for the loading of broken stone, pebbles, stones, and the like and having a cross-section which is enlarged in comparison with an opposed outlet opening 4 for the discharge of the material treated, after crushing and screening.

A stone-crushing mechanism is mounted in the scoop-shaped body 2 and comprises a movable crushing jaw 5 and an opposed fixed crushing jaw 6 fixed firmly to the body 2. Both the movable jaw and the fixed jaw 5, 6 include respective frames 5*a*, 6*a* on which plates 5*b*, 6*b* are fitted removably; the plates 5*b*, 6*b* are provided with longitudinal grooves, all indicated 20, extending parallel to the direction of flow of the stone introduced and suitable for facilitating the crushing thereof. The grooves 20 define a plurality of ribs 20*a* and recesses 20*b*, alternating in succession in a manner such that a rib 20*a* of the movable jaw 5 corresponds to a recess 20*b* of the fixed jaw 6, so that, during the movement of the first movable jaw 5, the crushing of the material is homogeneous. Moreover, since the ribs 20*a* of one jaw can penetrate the recesses 20*b* of the other jaw, the crushing can be particularly fine.

The plates 5*b*, 6*b* are reinforced and restrained, by respective undercuts, through the provision of retaining strips 40.

Respective first and second opposite ends 7, 8 are defined in each of the jaws 5, 6, the first ends 7 of the fixed and movable jaws 6, 5 being positioned in the region of the inlet opening 3, and the second ends 8 being positioned in the region of the outlet opening 4. The distance between the first ends 7 of the jaws 5 and 6 determines the maximum size of the stone which can be loaded into the bucket 1 and is greater than the distance between the second ends 8 which, on the other hand, is correlated with the desired maximum size of the crushed stone at the outlet opening 4. Both the distance between the first ends 7 and the distance between the second ends 8 are adjustable, as explained in detail below.

The bucket 1 also has an element for moving the movable jaw 5, including a drive mechanism 9, for example, a hydraulic motor, which is housed inside the scoop-shaped body 2 and drives a drive shaft 10 on which a first pulley 11 is keyed. The rotary movement of the first pulley 11 is transmitted, through a belt transmission 12, to a second pulley 13, keyed to a shaft 14.

A first eccentric 15 and a second eccentric 16 are arranged on the shaft 14, in phase with one another, and each is coupled with a respective first or second bearing 17, 18. A hollow sleeve 19 is fitted on the two bearings 17, 18 so as to be freely rotatable relative thereto and the movable jaw 5 is fixed, in the region of its first end 7, to the outer surface 19*a* of the sleeve 19, so as to be moved by the shaft 14 together with the sleeve 19.

The drive mechanism 9 is also arranged, when necessary, to drive a vibrator 50 acting on the fixed jaw 6 and disposed in the region of the inlet opening 3, for bringing about pulsed vibrations of the jaw 6 so as to release any material which has become stuck.

The bucket 1 also comprises an adjuster 22 for changing the movement of the movable jaw 5 and the size of the cross-section of the outlet opening 4. The adjuster 22 comprises a strut 23 interposed and restrained between respective first and second channels 25, 33, of which one is mounted on the frame 5*a* of the movable jaw 5 and the other on a support 41 fixed firmly to the scoop-shaped body 2. The ends 24*a*, 24*b* of the strut 23 which are housed in the channels 25, 33 are rounded to facilitate their pivoting about the respective contact lines.

A set of removable spacers 34 is interposed between the support 41 and the corresponding second channel 33 for the adjustment of the size of the cross-section of the outlet opening 4. The second channel 33 is welded to the end spacer.

Figure 4:
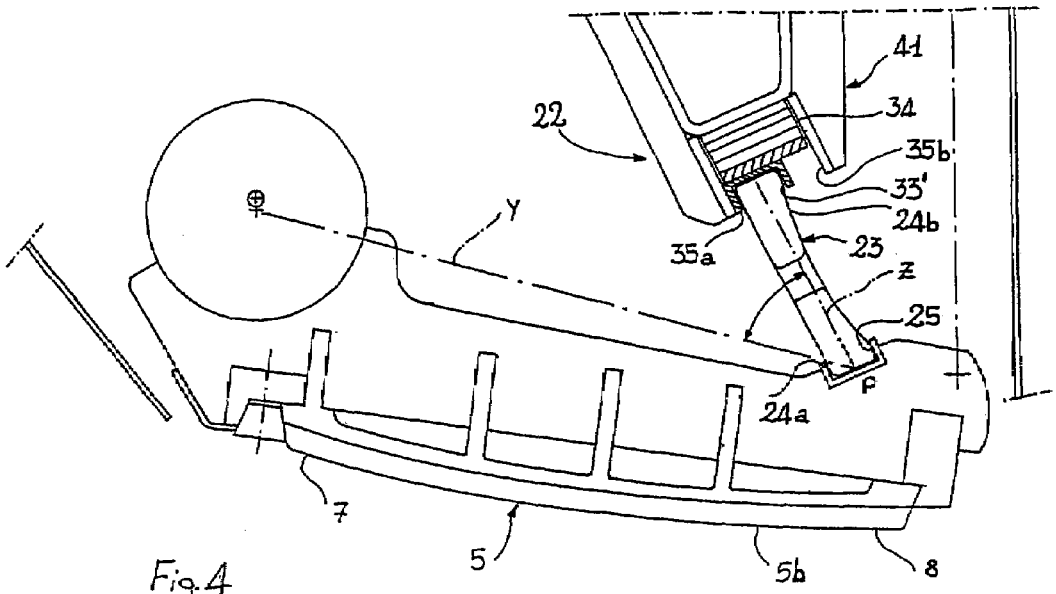
FIG. 4 is a view showing a detail of a further embodiment of the bucket of FIG. 1, on an enlarged scale.
Figure 5:
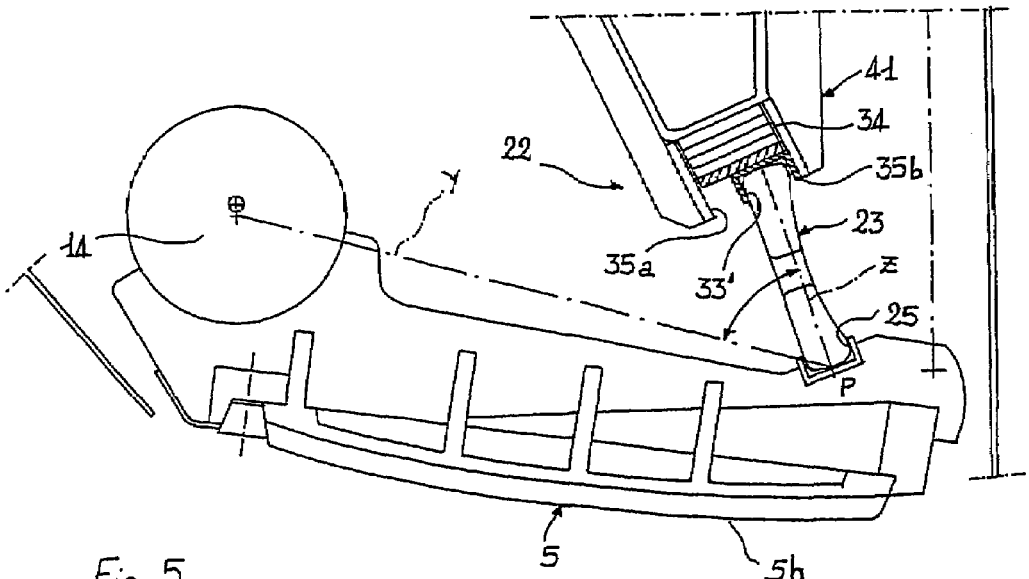
FIG. 5 is a view of the detail of FIG. 4 in a further operative position.

In a first embodiment of the invention of FIG. 1, the channel 33 is welded centrally to the end spacer whereas, in a further embodiment shown in FIGS. 4 and 5, the channel 33' is welded in the region of an edge of the spacer. By varying the position of the second channel 33, 33' relative to the end spacer, the angle between the movable jaw 5 and the strut 23 can in turn be adjusted in order to vary in the manner described below. By virtue of the characteristics just described, the strut 23 can be positioned in three different operative positions: a first, central operative position, in which the second channel 33 is spaced equally from two opposed walls 35*a*, 35*b* of the support 41, and which can be achieved with the use of the channel 33 welded as shown in FIG. 1; a second operative position in which the channel 33' is close to the first wall 35*a*; and a third position in which it is close to the second wall 35*b*, which can be achieved, from the second operative position, by removing the spacer and channel 33' and reinserting them having rotated them through 180° (thus changing from the operative position of FIG. 4 to that of FIG. 5). According to the operative position selected, the angle formed between the strut 23 and the movable jaw 5, in particular, the angle between an axis Y joining the center of rotation of the second pulley 13 and the point P at which the strut 23 is supported in the first channel 25, and an axis Z of the strut 23 extending through the support point P, is varied. This angle is 45°, 40°, and 50° in the three operative positions listed above, respectively.

The bucket 1 also comprises a resilient mechanism, in particular, a spring 30, a first end of which is connected to the scoop-shaped body 2, and a second, opposite end of which is connected to the second end 8 of the movable jaw 5, so as to keep the strut 23 restrained between the first and second channels 25, 33 (or 33') during the movement of the jaw 5. A mechanism 51 for adjusting the load exerted by the spring 30, such as a screw coupling system, is also provided on the scoop-shaped body 2.

The bucket 1 according to the exemplary embodiments of the invention operates as follows.

The stone or other material to be crushed is collected by the bucket 1 in a conventional manner. In order to send the material collected towards the jaws 5, 6, the bucket 1 is pivoted through 900 from the position in which it is shown in FIG. 1, that is, the outlet opening 4 is arranged at a height below the inlet opening 3 so that the material is urged towards the jaws 5, 6 simply by the effect of gravity.

The flow of material is facilitated with the use of the vibrator 50, even if the inlet opening 3 is positioned at the same height as the outlet opening 4.

The movable jaw 5 is moved by operation of the hydraulic motor (a particular embodiment of the drive mechanism 9) which transfers the movement from the first pulley 11 to the second pulley 13 and consequently to the shaft 14. Owing to the effect of the two eccentrics 15, 16, the hollow sleeve 19, which is freely rotatable on the bearings 17, 18, can perform a rotational/translational movement relative to the axis of the shaft 14; in particular, the first end 7 of the movable jaw 5, which is fixed to the sleeve 19, is moved from a first position, in which the inlet opening 3 has a maximum cross-section, to a second, opposite position which differs from the first by a rotation of the eccentrics 15, 16 through 180°, and in which the inlet opening 3 has a minimum cross-section. The first end 7 of the movable jaw 5 adopts all of the intermediate positions between the above-defined first and second positions, during its rotational/translational movement.

Since the movable jaw 5 is a rigid body, movements of the first end 7 result in corresponding movements of the second end 8 which, however, is restrained by the spring 30 and by the strut 23. The movements of the end 8 are permitted by the pivoting of the ends 24*a*, 24*b* of the strut 23 within the first and second channels 25, 33 (33'), respectively, so that the inclination of the strut 23 relative to the jaw 5 is varied continuously during the movement of the movable jaw 5. The resulting movement comprises a component substantially perpendicular to the movable jaw 5 and a component parallel thereto, along the direction of flow of the stone, in a manner similar to a "chewing" motion, promoting crushing of the stone and its movement towards the outlet opening 4.

The maximum size of the cross-section of the outlet opening 4 can also be adjusted by increasing or reducing the number of spacers 34 located inside the support 41, thus varying the maximum size of the crushed stone.

The movement of the movable jaw 5 can also be modified, thus changing the characteristics of the crushing due to the relative movement of the jaws 5, 6, by varying the inclination between the strut 23 and the movable jaw 5 at rest, as described above. With the use of the configuration shown in FIG. 4, in which the inclination between the strut 23 and the movable jaw 5 is least, the movement of the end 8 of the movable jaw 5 comprises a considerable translational component in the direction of the flow of the material, thus facilitating the movement of the material towards the outlet opening 4. This position is therefore particularly suitable when materials which form blockages easily, for example, moist or fine-grained materials, are being processed. The positioning shown in FIG. 5, which can be achieved by rotating the channel 33' welded to the spacer 34 through 180°, on the other hand, is particularly suitable when a considerable crushing power is required.

The invention thus achieves the objects proposed, also affording numerous advantages over the known devices referred to.

A first advantage afforded by the bucket according to the invention is that it is possible to optimize the crushing of the stone by virtue of the plurality of adjustments permitted, by adjusting the relative movement of the jaws in dependence on the material.

Moreover, the size of the crushed stone can easily be adjusted.

One of the main advantages is that the power consumption of the bucket according to the invention is less than that of conventional buckets, by virtue of the greater efficiency achieved by the process, which also leads to a reduction in processing time and to a reduction in noise emitted.

Moreover, the crushing performed by the above-described bucket is particularly uniform.

One of the main advantages is that, by virtue of the type of movement of the jaw and of the provision of a vibrator, blockages of material and consequent stoppages of the processing are minimized.

Although illustrated and described above with reference to certain specific embodiments and examples, the present invention is nevertheless not intended to be limited to the details shown. Rather, various modifications may be made in the details within the scope and range of equivalents of the claims and without departing from the spirit of the invention.

The invention claimed is:

1. A bucket for crushing and screening stone and similar materials, comprising:

a scoop-shaped body defining an inlet opening for the stone to be crushed and an outlet opening for the crushed stone, between which a direction of flow of the stone is defined;

a mechanism for crushing the stone, the crushing mechanism having a first jaw and a second jaw housed in the scoop-shaped body and movable relative to one another; and an element including at least one eccentric for moving the first jaw relative to the second jaw, the element imparting to the first jaw a combined rotational and translational movement relative to the second jaw, in which a first component of the movement is away from and towards the second jaw and a second component of the movement is substantially parallel to the direction of flow, the combined movement creating a chewing motion, the at least one eccentric rotating through 180° to define a first position, in which the inlet opening has a maximum cross-section, and a second position, in which the inlet opening has a minimum cross-section.

2. The bucket according to claim 1, further comprising an adjuster changing the size of the cross-section of the outlet opening and the movement of the first jaw.

3. The bucket according to claim 2 in which the first jaw and the second jaw each comprises respective first and second opposite ends which are positioned, with reference to the direction of flow, in the region of the inlet opening and in the region of the outlet opening, respectively, the element acting on the first end of the first jaw.

4. The bucket according to claim 3 in which the second end of the first jaw is coupled with the adjuster.

5. The bucket according to claim 3 further comprising a sleeve coupled to the at least one eccentric in a freely rotatable manner, the sleeve being fixed firmly to the first end of the first jaw.

6. The bucket according to claim 5 in which the element comprises two eccentrics moved by a shaft driven by a drive mechanism, the two eccentrics being coupled with two bearings on which the sleeve is fitted.

7. The bucket according to claim 3 in which the adjuster comprises a strut interposed at an adjustable inclination between the second end of the first jaw and the scoop-shaped body.

8. The bucket according to claim 7 in which the second end of the first jaw comprises a first channel for housing a first end of the strut in an orientable manner.

9. The bucket according to claim 8 further comprising a support mounted on the scoop-shaped body and a set of removable spacers interposed between the support and a second channel which houses a second end of the strut.

10. The bucket according to claim 9 in which the second end of the strut is housed in the second channel in alternative operative positions, in order to adjust the inclination between the strut and the first jaw, at rest.

11. The bucket according to claim 1 in which each of the first jaw and the second jaw comprises a respective frame on which respective plates are fitted removably.

12. The bucket according to claim 11 in which a plurality of grooves are formed on facing surfaces of the plates.

13. The bucket according to claim 12 in which the grooves are parallel to one another and extend in the direction of the flow of the stone.

14. The bucket according to claim 13 in which the grooves define a plurality of ribs and recesses alternating in succession in a manner such that a rib of the first jaw corresponds to a recess of the second jaw.

15. The bucket according to claim 1 in which the second jaw is fixed firmly to the scoop-shaped body.

16. The bucket according to claim 7, further comprising a resilient mechanism resiliently urging the second end of the first jaw against the strut.

17. The bucket according to claim 16, further comprising means for adjusting the load of the resilient mechanism.

18. The bucket according to claim 1, further comprising a vibrator disposed in the region of the inlet opening for bringing about pulsed vibration of the second jaw.

19. A bucket for crushing and screening stone and similar materials, comprising:

a scoop-shaped body defining an inlet opening for the stone to be crushed and an outlet opening for the crushed stone, between which a direction of flow of the stone is defined;

a mechanism for crushing the stone, the crushing mechanism having a first jaw and a second jaw housed in the scoop-shaped body and movable relative to one another, the first jaw and the second jaw each having respective first and second opposite ends and the second jaw being fixed firmly to the scoop-shaped body;

an adjuster coupled with the second end of the first jaw, the adjuster changing the size of the cross-section of the outlet opening and the movement of the first jaw and having a strut interposed at an adjustable inclination between the second end of the first jaw and the scoop-shaped body;

a resilient mechanism resiliently urging the second end of the first jaw against the strut;

means for adjusting the load of the resilient mechanism;

a vibrator disposed in the region of the inlet opening for bringing about pulsed vibration of the second jaw; and an element including at least one eccentric for moving the first jaw relative to the second jaw, the element imparting to the first jaw a combined rotational and translational movement relative to the second jaw, in which a first component of the movement is away from and towards the second jaw and a second component of the movement is substantially parallel to the direction of flow, the combined movement creating a chewing motion, the at least one eccentric rotating through 180° to define a first position, in which the inlet opening has a maximum cross-section, and a second position, in which the inlet opening has a minimum cross-section;

wherein the respective first and second opposite ends of the first jaw and the second jaw are positioned, with reference to the direction of flow, in the region of the inlet opening and in the region of the outlet opening, respectively, the element acting on the first end of the first jaw.

20. A bucket for crushing and screening stone and similar materials, comprising:

a scoop-shaped body defining an inlet opening for the stone to be crushed and an outlet opening for the crushed stone, between which a direction of flow of the stone is defined;

a mechanism for crushing the stone, the crushing mechanism having a first jaw and a second jaw housed in the scoop-shaped body and movable relative to one another, the first jaw and the second jaw each having a respective frame on which respective plates are fitted removably and each having respective first and second opposite ends, the second jaw being fixed firmly to the scoop-shaped body;

a plurality of grooves formed on facing surfaces of the plates, the grooves paralleling one another, extending in the direction of the flow of the stone, and defining a plurality of ribs and recesses alternating in succession in a manner such that a rib of the first jaw corresponds to a recess of the second jaw;

an adjuster coupled with the second end of the first jaw, the adjuster changing the size of the cross-section of the outlet opening and the movement of the first jaw and having a strut interposed at an adjustable inclination between the second end of the first jaw and the scoop-shaped body, the strut having a first end and a second end with the first end of the strut being housed in a first channel of the second end of the first jaw in an orientable manner;

a support mounted on the scoop-shaped body and a set of removable spacers interposed between the support and a second channel which houses the second end of the strut, the second end of the strut housed in the second channel in alternative operative positions, in order to adjust the inclination between the strut and the first jaw, at rest;

a resilient mechanism resiliently urging the second end of the first jaw against the strut;

means for adjusting the load of the resilient mechanism;

a vibrator disposed in the region of the inlet opening for bringing about pulsed vibration of the second jaw; and an element for moving the first jaw relative to the second jaw such that imparted to the first jaw is a combined rotational and translational movement relative to the second jaw, in which a first component of the movement is away from and towards the second jaw and a second component of the movement is substantially parallel to the direction of flow, the combined movement creating a chewing motion, the element including two eccentrics moved by a shaft driven by a drive mechanism and coupled with two bearings on which a sleeve is fitted, the sleeve coupled to the eccentrics in a freely rotatable manner and fixed firmly to the first end of the first jaw, and the eccentrics rotating through 180° to define a first position, in which the inlet opening has a maximum cross-section, and a second position, in which the inlet opening has a minimum cross-section;

wherein the respective first and second opposite ends of the first jaw and the second jaw are positioned, with reference to the direction of flow, in the region of the inlet opening and in the region of the outlet opening, respectively, the element acting on the first end of the first jaw.

* * * * *